US012736217B2

(12) United States Patent
Wallin

(10) Patent No.: US 12,736,217 B2
(45) Date of Patent: Sep. 15, 2026

(54) COOLING SHIELD FOR A LIQUOR INJECTION PIPE OF A LIQUOR GUN, LIQUOR GUN SYSTEM COMPRISING THE COOLING SHIELD, AND METHOD FOR COOLING A LIQUOR INJECTION PIPE IN A LIQUOR GUN SYSTEM

(71) Applicant: VALMET AB, Sundsvall (SE)

(72) Inventor: Erik Olof Wallin, Kullavik (SE)

(73) Assignee: VALMET AB, Sundsvall (SE)

( * ) Notice: Subject to any disclaimer, the term of this patent is extended or adjusted under 35 U.S.C. 154(b) by 858 days.

(21) Appl. No.: 18/004,075

(22) PCT Filed: Jun. 16, 2021

(86) PCT No.: PCT/SE2021/050588
§ 371 (c)(1),
(2) Date: Jan. 3, 2023

(87) PCT Pub. No.: WO2022/010395
PCT Pub. Date: Jan. 13, 2022

(65) Prior Publication Data

US 2023/0266001 A1 Aug. 24, 2023

(30) Foreign Application Priority Data

Jul. 9, 2020 (SE) ..... 2050871-9

(51) Int. Cl.
*F23D 11/36* (2006.01)
*D21C 11/14* (2006.01)
*F23G 7/04* (2006.01)

(52) U.S. Cl.
CPC ..... *F23D 11/36* (2013.01); *D21C 11/14* (2013.01); *F23G 7/04* (2013.01); *F23D 2202/00* (2013.01);
(Continued)

(58) Field of Classification Search
None
See application file for complete search history.

(56) References Cited

U.S. PATENT DOCUMENTS 3,779,180 A 12/1973 Hardemann
2011/0132241 A1 6/2011 Dostal et al.

FOREIGN PATENT DOCUMENTS

CN 106624264 A * 5/2017 ..... B23K 9/323
CN 207685586 U 8/2018
(Continued)

OTHER PUBLICATIONS

Swedish Search Report issued in connection with SE Appl. Ser. No. 2050871-9 dated Mar. 1, 2021.

*Primary Examiner* — Jason Lau
(74) *Attorney, Agent, or Firm* — Foley & Lardner LLP

(57) ABSTRACT

A cooling shield for a liquor injection pipe of a liquor gun for supplying liquor to a combustion chamber of a recovery boiler, which has a first and a second side edge, the side edges extending in a longitudinal direction (L) of the cooling shield, and a first end edge and a second end edge extending between the side edges, the cooling shield comprising an outside shield wall, and an inside shield wall, the outside shield wall and the inside shield wall being connected along the side edges of the cooling shield, the cooling shield comprising a cooling medium space being arranged between the outside shield wall and the inside shield wall, the cooling shield comprising a cooling medium inlet and a cooling medium outlet the cooling medium inlet and the cooling medium outlet being arranged in communication with the cooling medium space.

20 Claims, 3 Drawing Sheets

(52) U.S. Cl.
CPC .. *F23G 2206/203* (2013.01); *F23G 2209/101* (2013.01)

(56) References Cited

FOREIGN PATENT DOCUMENTS

| | | | |
|---|---|---|---|
| EP | 2 022 888 | A1 | 2/2009 |
| SE | 524274 | C2 | 7/2004 |
| WO | WO-2016/071537 | A1 | 5/2016 |

* cited by examiner

COOLING SHIELD FOR A LIQUOR INJECTION PIPE OF A LIQUOR GUN, LIQUOR GUN SYSTEM COMPRISING THE COOLING SHIELD, AND METHOD FOR COOLING A LIQUOR INJECTION PIPE IN A LIQUOR GUN SYSTEM

TECHNICAL FIELD

The invention relates to a cooling shield for a liquor injection pipe of a liquor gun for supplying liquor to a combustion chamber of a recovery boiler. The invention also relates to a liquor gun system comprising such a shield and a liquor gun. The invention further relates to a method for cooling and shielding the liquor injection pipe of the liquor gun in the liquor gun system.

BACKGROUND

Chemical cellulose production generates waste liquor, e.g. black liquor, comprising chemicals used in the pulping process. These chemicals are recovered in a recovery process that involves injecting the waste liquor into a combustion chamber in a recovery boiler, where the waste liquor is combusted, which initiates chemical processes for recovery of the process chemicals while also generating heat for production of high pressure steam. A major part of inorganic matter present in the waste liquor is withdrawn from the combustion chamber via smelt spouts located at the lower part of the combustion chamber. A smaller part of the inorganic matter exits the combustion chamber with the flue gas at an upper portion of the combustion chamber.

The waste liquor is injected into the combustion chamber in the form of droplets by means of liquor guns. A liquor gun comprises a liquor injection pipe for delivering the waste liquor into the recovery boiler. The end of the liquor injection pipe located inside the combustion chamber is provided with a nozzle. The nozzle may be provided with a deflector plate that ensures that the waste liquor is injected into the combustion chamber as symmetrically as possible. Other examples of nozzles which are being used are nozzles known as beer can nozzles and swirl cone nozzles.

In the combustion chamber the inorganic material is in melted form and whirls around and causes strong corrosion in un-cooled steel surfaces, as well as deposition and fouling on the chamber walls and on the liquor gun or liquor guns. These depositions may fall down and damage the liquor gun. Corrosion may also be caused by accumulation and ignition of unburned waste liquor on the surface of the liquor gun. For these reasons, a liquor gun is usually cleaned at regular intervals by a person or by means of a mechanical device. However, the extremely corrosive conditions and high temperatures in the combustion chamber means that the liquor guns must be replaced with short intervals, sometimes as often as once a day.

An attempt to solve these problems is presented in EP 2022888 A1, wherein a liquor injection pipe is surrounded by an outer casing tube and wherein an "emulsion" of water and steam is injected into a space formed between the liquor injection pipe and the outer casing tube. The water is used as a cooling medium that maintains the temperature of the liquor injection pipe at an acceptable level in view of operability and prevention of corrosion. Moreover, the liquor injection pipe is cleaned during a special sooting (cleaning) stage, wherein water/steam is introduced at an appropriate temperature required for keeping the liquor injection pipe clean. The casing tube is also provided with holes or pores for letting out steam and small amounts of non-vaporized water. The injected steam increases the flow velocity sufficiently so that the holes or pores in the casing tube do not get clogged but remain open. In embodiments wherein water and steam are fed separately into the space between the liquor injection pipe and the casing tube, an additional intermediate casing may be arranged between the outer casing tube and the liquor injection pipe. The water is then supplied into an emulsion space formed between the outer casing tube and the intermediate casing, whereas the steam is supplied to a steam space formed between the intermediate casing and the liquor injection pipe. From the steam space, the steam may enter the emulsion space via openings in the intermediate casing. Alternatively, the steam can be introduced into the emulsion space via a pipe arranged in the emulsion space or in principle also via a pipe arranged inside the liquor injection pipe.

The arrangement in EP 2022888 A1 provides for improved temperature control and cleaning of the liquor injection pipe and thereby a prolonged service life for the liquor gun. However, the arrangement in EP 2022888 A1 is a relatively expensive and technically complex arrangement.

A less complicated cleaning arrangement for a liquor gun is presented in SE 524 274C2, wherein steam is injected into the combustion chamber around the liquor injection pipe of the liquor gun to prevent matter within the combustion chamber from sticking to the liquor injection pipe. The steam flow also ensures that the space around the liquor injection pipe is inert and thus prevents combustion of matter attached to the liquor injection pipe. The arrangement in SE 524 274C2 has only a very limited cooling effect on the liquor injection pipe.

Objects

An object of the invention is to provide a simple, yet effective and cost efficient means for protecting, cooling and cleaning a liquor injection pipe of a liquor gun within a recovery boiler.

A further object of the invention is to provide a system offering a simple, effective and cost-efficient protection, cooling and cleaning of a liquor injection pipe of a liquor gun within a recovery boiler.

Another object of the invention is to provide a simple effective and cost efficient method for protecting, cleaning and cooling a liquor injection pipe of a liquor gun within a recovery boiler.

SUMMARY

One or more of the above objects may be achieved with a cooling shield in accordance with claim 1, a liquor gun system according to claim 10 and a method according to claim 14. Variations of the disclosure are set out in the dependent claims and in the following description.

Disclosed herein is a cooling shield for a liquor injection pipe of a liquor gun for supplying liquor to a combustion chamber of a recovery boiler. The cooling shield has a first and a second side edge, the side edges extending in a longitudinal direction of the cooling shield, and a first and a second end edge extending between the side edges, the cooling shield comprising an outside shield wall, and an inside shield wall, the outside shield wall and the inside shield wall being connected along the side edges of the cooling shield, the cooling shield comprising a cooling medium space being arranged between the outside shield wall and the inside shield wall, and a cooling medium inlet and a cooling medium outlet being arranged in the cooling shield in communication with the cooling medium space.

The cooling shield is a double-walled structure formed by two plates arranged at a distance from each other at least in a longitudinally extending central portion of the cooling shield. Longitudinally extending side edges of the plates may be directly joined to each other along the side edges of the cooling shield or the plates may be interconnected by means of side walls extending along the side edges of the cooling shield.

The cooling shield may be provided as a separate part of a liquor gun system. The cooling shield may be inserted into the combustion chamber together with a liquor gun. Alternatively, the cooling shield may be inserted and removed from the combustion chamber independently of the liquor gun. The cooling shield may be directly or indirectly mounted to the liquor gun. The cooling shield may be mounted to the liquor gun on the outside of the combustion chamber, such as by being mounted on a liquor gun stand on which the liquor gun is mounted. The liquor gun stand may be in the form of a bench which is attached at one end to the outside of the combustion chamber wall below an insertion opening in the combustion chamber wall. The bench is arranged to support a length of the liquor gun outside of the combustion chamber and is provided with a sliding arrangement for moving the combustion chamber end of the liquor injection pipe of the liquor gun through the insertion opening into the combustion chamber and back out of the combustion chamber.

By providing the cooling shield as a separate component, the cooling shield can be replaced without at the same time having to replace the more complicated and expensive liquor gun. In addition, the liquor gun can be replaced without replacing the cooling shield. The cooling shield may be expected to have a longer service life than a liquor gun, as there is no internal flow of hot and corrosive waste liquor inside the cooling shield.

Alternatively, the cooling shield may form an integral part of a liquor gun. A cooling shield which forms an integral part of a liquor gun may be inserted into and removed from a combustion chamber of a recovery boiler together with the liquor gun.

The inside shield wall is the part of the cooling shield which will be facing a liquor injection pipe of a liquor gun when the cooling shield is used for cooling and protecting the liquor injection pipe inside the combustion chamber of a recovery boiler. The outside shield wall is the part of the cooling shield which will be facing away from the liquor injection pipe when the cooling shield is used for cooling and protecting the liquor injection pipe inside the combustion chamber of a recovery boiler.

As set out herein, more than one cooling medium inlet may be provided in the cooling shield. The cooling shield may comprise a plurality of cooling medium outlets being arranged for letting out gaseous cooling medium such as vaporized water and a gaseous transport medium into the combustion chamber of the recovery boiler. Small amounts of non-vaporized water will generally also escape out from the cooling medium outlets. The cooling medium outlets are preferably distributed over the full length of the combustion chamber end of the cooling shield. The plurality of cooling medium outlets may be arranged in the outside shield wall and may be distributed over the full area of the outside shield wall in the combustion chamber end of the cooling shield so that no pockets are created in the cooling medium space where adequate circulation of cooling medium cannot take place. The spent cooling medium which escapes out through the plurality of cooling medium outlets contributes to the protection of the liquor injection pipe by deflecting matter inside the combustion chamber away from the immediate vicinity of the liquor injection pipe.

A recovery boiler is fuelled by waste liquor e.g., black liquor from a Kraft pulping process which is combusted in the combustion chamber of the recovery boiler. The conditions inside the combustion chamber are extremely harsh, which means that a liquor injection pipe inserted in the combustion chamber is exposed to a hot and very corrosive atmosphere, as well as to liquor droplets that stick to, and burn on the injection pipe, thus damaging the pipe material.

Furthermore, although ideally all liquor should be present at the bottom of the combustion chamber during the process, in reality a portion of the liquor will end up on the walls of the combustion chamber where it dries and burns and may form large chunks of solid material which may fall down into the chamber and potentially hit and damage a liquor gun or even dislocate the liquor gun.

The cooling shield as disclosed herein alleviates the impact on the liquor injection pipe from the hot and chemically harsh environment inside the combustion chamber as well as providing mechanical protection against solid matter swirling around in the combustion chamber or falling down from the walls of the combustion chamber.

The invention is based on the surprising realization that it is not necessary to provide a protection that extends all the way around the liquor injection pipe, even though melted liquor swirls around and moves up and down within the combustion chamber and attaches to all sides of the liquor injection pipe, and all sides of the liquor injection pipe are exposed to the extremely hot and corrosive environment within the combustion chamber. The reason for this is that the uppermost portion of the liquor injection pipe is much more exposed, especially from falling matter within the combustion chamber. Thus, protecting only the uppermost portion of the liquor injection pipe has been found to be sufficient to significantly extend the lifespan of the liquor gun.

The cooling shield as disclosed herein may be a curved cooling shield. The curved cooling shield has an extension in a circumferential direction extending along a part of a tubular cross-section. The part may be only a small part of a tubular cross section such as 30% to 50% of a tubular cross section. Alternatively, the curved cooling shield may extend along more than 50% of a tubular cross section such as up to 80% of a tubular cross section. In such cases, the cooling shield may be described as having a tubular cross-sectional shape with a longitudinally extending gap in the wall of the tube. By a tubular cross-section is implied a cross section forming a closed loop. The tubular cross-section may have any suitable shape such as circular or oval or may have a modified circular or oval shape with different curvatures in different parts of the tubular cross-section. The cooling shield may have outside and inside shield walls placed at a uniform distance from each other over the full extension of the cooling shield between the side edges of the cooling shield.

Alternatively the distance between the outside and inside shield walls may vary in a circumferential direction of the cooling shield, i.e. in a direction between the side edges of the cooling shield along the outer surface of the outside shield wall e.g., if the outside and inside shield walls are joined directly to each other along the side edges of the cooling shield.

The cooling shield may be arranged at least partly above the liquor injection pipe without extending all the way around the circumference of the liquor injection pipe. Thereby, the shield protects the most exposed upper portion of the liquor injection pipe from falling and swirling matter whereas the water containing cooling medium delivered into the cooling space inside the cooling shield maintains the most exposed portion of the liquor injection pipe at a lowered temperature. Thus, the shield fulfils its main purpose, which is to protect and cool the most exposed portion of the liquor injection pipe and to increase the life span of the liquor gun.

One advantage of the invention is that the shield, which does not extend all the way around the liquor injection pipe, can be made as a separate piece, which can be removably attached, for example, to the liquor gun. This makes it possible to replace the shield without replacing the liquor gun and this significantly reduces the production costs. It is particularly advantageous that the cooling shield can be removably attached also when the liquor injection pipe comprises a curved section. Most known liquor injection pipes comprise a curved section and protection devices arranged around them are permanently fixed to the liquor guns, which means that the entire liquor gun must be replaced together with the shield. A removable cooling shield may also be advantageous in that it can be used together with most common types of liquor guns.

Another advantage is that material costs for the shield are low in comparison to protection devices extending all the way around the liquor injection pipe.

As disclosed above, the shield may be adapted to be removably attached with respect to the liquor injection pipe. That is, the shield does not constitute an integral part of the liquor gun. The cooling shield may, for example, be removably attached to the liquor gun and/or to a liquor gun stand, as disclosed herein.

The cooling medium outlet may comprise or consist of a plurality of openings or pores in the outside shield wall. Cooling medium outlets may also be arranged in side walls and/or an end wall of the combustion chamber end of the cooling shield.

The plates forming the outside shield wall and the inside shield wall may be curved in a radial direction of the cooling shield to provide the shield with an overall curved shape. The radial direction of the cooling shield may also be referred to as the circumferential direction of the cooling shield. A curved outer surface of the outside shield wall may be preferred, so that matter falling on the cooling shield falls off the sides of the shield and does not accumulate on the outer surface of the cooling shield.

Alternatively, the shield may have an overall planar shape. It is also conceivable that the outside shield wall is curved while the inside shield wall is planar. The curvature of the inside shield wall and/or the outside shield wall may vary along the length of the cooling shield.

A radius of curvature of the inside shield wall may be equal to the radius of curvature of the outside shield wall or may be smaller or greater than the radius of curvature of the outside shield wall.

The radius of curvature of the outside shield wall and of the inside shield wall are preferably greater than the radius of curvature of a liquor injection pipe which the cooling shield is intended to be shielding when in use. Thereby the cooling shield may encircle at least an upper part of the liquor injection pipe and preferably also side parts of the liquor injection pipe.

A cross-section through the cooling shield may have a uniform curvature between the first and second side edges of the outside shield wall and the inside shield wall, with a uniform distance between the outside shield wall and the inside shield wall.

A cross section through the cooling shield may extend in a circumferential direction of the cooling shield over a circle segment of from 60° to 300°, such as from 90° to 180°.

As set out herein, the outside shield wall may be connected to the inside shield wall by a first side wall extending along the first side edge of the cooling shield and by a second side wall extending along the second side edge of the cooling shield.

The cooling medium space may be closed at one or both ends of the cooling shield. It may be preferred that the cooling medium space is closed at least at a second end of the cooling shield which is configured for being arranged at a distance from a combustion chamber wall inside a combustion chamber of a recovery boiler, e.g. at a nozzle at the end of a liquor injection pipe. It may be preferred that at least the end of the cooling shield which is placed inside the combustion chamber of the recovery boiler is closed so that cooling medium can pass out in a controlled manner from the cooling medium space through the cooling medium outlets in the outside wall of the cooling shield.

As set out herein, the outside shield wall may be connected to the inside shield wall by a first end wall extending along the first end edge of the cooling shield and optionally by a second end wall extending along the second end edge of the cooling shield.

The size of the liquor injection pipe of a liquor gun depends on the size of the recovery boiler for which the liquor gun is designed. A liquor injection pipe in a liquor gun for a large recovery boiler may have a diameter of up to approximately 7 cm. For smaller recovery boilers, the liquor injection pipe of the liquor gun may have a diameter of down to approximately 3 cm. The dimensions of the cooling shield may be adapted to the size of the liquor gun which it is intended to be used for protecting.

A cooling shield can be shaped and configured to fit with only a particular type of liquor gun and may have a shape in the longitudinal direction as well as in a circumferential direction which is adapted to a particular liquor gun. A cooling shield which is adapted for a particular liquor gun may have a shape which conforms closely to the outer shape of the liquor injection pipe of the liquor gun. The cooling shield may be bent in the longitudinal direction in the same way as the liquor injection pipe of the liquor gun and may curve along the outer circumference of the liquor injection pipe not only at an upper part of the liquor injection pipe, but also down on the sides of the liquor injection pipe.

It is also conceivable to make the cooling shield with a shape and size which may allow the cooling shield to be used with a range of liquor guns. A cooling shield which may be used with differently shaped liquor guns will generally have a more simple shape, e.g. the cooling shield may be without bends in the longitudinal direction and may have a generally flat or only slightly curved shape in the cross direction such that basically only an upper part of the liquor injection pipe of the liquor gun is shielded by the cooling shield.

When in use, the cooling shield may be in direct contact with the liquor injection pipe of the liquor gun over at least a portion of the length of the cooling shield. Alternatively, the cooling shield may be placed at a distance from the liquor injection pipe of the liquor gun over the full length of the cooling shield. A distance between the cooling shield and the liquor injection pipe of the liquor gun can be in the order of up to 1 cm.

In a planar cooling shield, the maximum width of the cooling shield will be the distance between the side edges of the cooling shield. In a curved cooling shield, the maximum width of the cooling shield will be the width of a planar projection of the cooling shield in a plane parallel with and perpendicular to the longitudinal direction of the cooling shield. The thickness of the cooling shield is measured as the distance between an outer surface of the outside wall and an outer surface of the inside wall. In a planar cooling shield, the thickness is measured perpendicular to the length direction and the width direction. In a curved cooling shield, the thickness is measured in a radial direction of the outer surface of the outside wall.

Disclosed herein is also a liquor gun system comprising a liquor gun and a cooling shield as disclosed herein. The liquor gun comprises a liquor injection pipe for supplying liquor to a combustion chamber of a recovery boiler. The liquor injection pipe comprises a nozzle arranged at a combustion chamber end of the liquor injection pipe, the combustion chamber end of the liquor injection pipe being a part of the liquor injection pipe which is configured for being inserted into the combustion chamber of the recovery boiler. The nozzle is arranged for ejecting liquor into the combustion chamber of the recovery boiler. The cooling shield is configured for being applied at least at the combustion chamber end of the of the liquor injection pipe, and to cover at least a portion of the length of an upper outer surface of the liquor injection pipe, with the inside shield wall of the cooling shield facing the liquor injection pipe and with the outside shield wall of the cooling shield facing away from the liquor injection pipe.

Application of the cooling shield at the combustion chamber end of the liquor injection pipe may involve mounting of the cooling shield to the liquor gun outside and/or inside of the wall of the combustion chamber. It may be preferred that the cooling shield is mounted together with the liquor gun on a liquor gun stand provided on the outside of the combustion chamber. Alternatively, the cooling shield may be separately mounted on the outside of the combustion chamber wall. The cooling shield may be mounted such that when the liquor injection pipe is inserted into the combustion chamber, the cooling shield extends along the liquor injection pipe of the liquor gun through an insertion opening in the combustion chamber wall and into the combustion chamber. The part of the cooling shield which is inserted into the combustion chamber is the combustion chamber end of the cooling shield.

In a liquor gun system as disclosed herein, the maximum width of the cooling shield is preferably equal to or greater than a maximum width of the combustion chamber end of the liquor injection pipe.

In a cylindrical liquor injection pipe, the maximum width of the liquor injection pipe is equal to the outer diameter of the liquor injection pipe. In liquor injection pipes having other cross-sectional shape, the maximum width of the liquor injection pipe is measured as the greatest width of a cross-section through the liquor injection pipe taken in a transverse direction perpendicular to and along the longitudinal direction of the liquor injection pipe.

When operational, the liquor gun and the cooling shield of the liquor gun system as disclosed herein are inserted into the combustion chamber of a recovery boiler in a generally horizontal direction, with the cooling shield applied above the liquor injection pipe of the liquor gun as seen in the vertical direction. The cooling shield is applied to cool at least the upper surface of the liquor injection pipe and to protect it from matter falling down from above. It has been found that the major part of damage to a liquor injection pipe inside a combustion chamber is on the upper part of the liquor injection pipe, causing the upper part of the liquor injection pipe to fail before the lower part. By arranging a cooling shield as disclosed herein to cover the upper surface of the liquor injection pipe, it has been found that the service life of the liquor injection pipe can be considerably prolonged.

The cooling shield may be arranged such that it may cover also at least parts of the sides of the liquor injection pipe. In a liquor gun system as disclosed herein a circumferential extension of the cooling shield around the liquor injection pipe may be from 60° to 300°, such as from 90° to 270°, from 100° to 200°, or from 110° to 190°, or from 100° to 180°, where the midpoint may be the uppermost part of the liquor injection pipe.

When applied inside the combustion chamber, the combustion chamber end of the cooling shield is arranged to cover at least a portion of the combustion chamber end of the liquor injection pipe. Thus, the extension of the cooling shield inside the combustion chamber as measured along a straight center line on the outside wall of the cooling shield from the combustion chamber wall is such that at least a portion of the upper outer surface of the liquor injection pipe is covered by the cooling shield. The cooling shield may extend along at least 70% of the length of the combustion chamber end of the liquor injection pipe, such as along 80% to 115%, or 90% to 100% of the length of the combustion chamber end of the liquor injection pipe. That is, the combustion chamber end of the cooling shield may have somewhat greater length than the combustion chamber end of the liquor injection pipe. In some applications, the combustion chamber end of the liquor injection pipe has one or more bends, e.g., a bend located close to the nozzle. Such bends are particularly vulnerable to corrosion and damage from hot matter in the combustion chamber. In such applications it may be preferred that the cooling shield extends over the bend or bends. It is also conceivable that the cooling shield has a bent configuration in the longitudinal direction to conform to the bent configuration of the liquor injection pipe. When used together with a liquor injection pipe having more than one bend, the cooling shield may be sized and configured such that at least a first bend in the liquor injection pipe as seen in a direction from the combustion chamber wall may be covered by the cooling shield.

The disclosure further pertains to a method for cooling and shielding a liquor injection pipe in a liquor gun system as disclosed herein, wherein the liquor gun system is mounted with the combustion chamber end of the liquor injection pipe and the combustion chamber end of the cooling shield inserted into a combustion chamber of a recovery boiler, the method comprising supplying a cooling medium comprising water and a gaseous transport medium such as steam to the cooling space in the cooling shield.

The cooling medium is supplied to the cooling space through one or more inlets in the cooling shield. The cooling medium may be supplied as separate components which mix in the cooling space to produce the cooling medium. Alternatively, the components of the cooling medium may be mixed before being supplied into the cooling space. Accordingly, different inlets may be used for different components of the cooling medium such as a gaseous transport medium and water. It is also conceivable to supply a pre-mixed cooling medium or a component of the cooling medium through inlets arranged at different locations along the liquor injection pipe. Water vapor may be a preferred transport medium. Other examples of conceivable transport media are flue gas, pressurized air and nitrogen. Mixtures of two or more transport media may also be used.

Throughout this disclosure, the term "combustion chamber" refers to the space defined between the walls of a recovery boiler. The combustion chamber does not include the combustion chamber walls.

Throughout this application, the term "longitudinal" refers to the general direction of length of a device as disclosed herein. A device having a generally longitudinal extension may comprise one or more curved sections that deviate from a straight longitudinal axis. In a Cartesian coordinate system, the longitudinal direction corresponds to the Y-direction.

The width of a device as disclosed herein is the extension of the device in a width direction, transverse to the longitudinal direction. In a Cartesian coordinate system, the width direction corresponds to the X-direction and the longitudinal direction corresponds to the Y direction.

The combustion chamber end of a cooling shield as disclosed herein, is the part of the cooling shield which is intended for being inserted into a combustion chamber of a recovery boiler. The combustion chamber end may also be referred to as an inner end of the cooling shield. The combustion chamber end of the cooling shield may constitute the entire cooling shield. The cooling shield may also comprise an outer end which is a part of the cooling shield which is intended for being positioned on the outside of the combustion chamber when the cooling shield is applied to a liquor gun which is inserted into a combustion chamber. The outer end of the cooling shield may be arranged to extend only into a liquor gun opening in the combustion chamber wall of a recovery boiler, but preferably has a longitudinal extension which allows the cooling shield to extend on the outside of the recovery boiler and to be mounted in an operational position in relation to the liquor gun on the outside of the recovery boiler.

A spout of a liquor pipe should be understood in its broadest sense as an opening at the end of the liquor pipe through which liquor is fed out into the combustion chamber of a recovery boiler. The spout may be any type of spout or nozzle as known in the art. The spout may simply be an open tube end or may comprise flow control features such as a flow distribution lip, etc.

BRIEF DESCRIPTION OF THE DRAWINGS

The cooling shield as disclosed herein will be further explained hereinafter with reference to the appended drawings wherein.

DETAILED DESCRIPTION

Different aspects of the present disclosure will be described more fully hereinafter with reference to the drawings. The cooling shield, the system and the method disclosed herein should not be construed as being limited to the aspects set forth herein but can be varied within the scope of the appended claims. In particular, it is to be understood that the exemplary shapes of the cooling shields shown in the Figures may be freely varied within the scope of the claims.

The drawings are schematic and are not necessarily drawn to scale.

Figure 1:
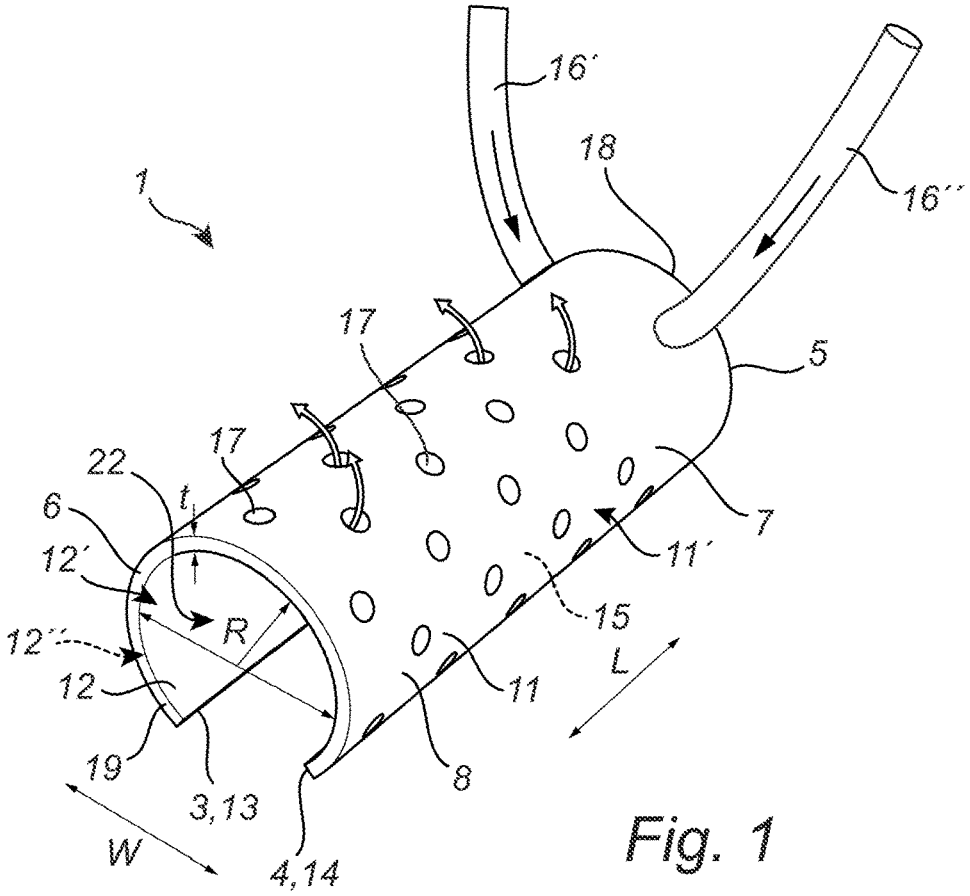
FIG. 1 shows a cooling shield for a liquor gun.

FIG. 1 shows a cooling shield 1 for a liquor injection pipe of a liquor gun for supplying liquor to a combustion chamber of a recovery boiler. The cooling shield 1 is shown in a highly simplified and shortened manner, having the form of a straight tubular structure with an open underside. As disclosed herein, the cooling shields of the invention may have any useful shape in the longitudinal direction and may be configured to conform to a bent shape of a liquor injection pipe of a liquor gun. Furthermore, it is to be understood that also the cross-sectional shape of the cooling shield may be different from that shown in FIG. 1, as disclosed herein.

The cooling shield 1 has a first side edge 3 and a second side edge 4, the side edges 3, 4 extending in a longitudinal direction L of the cooling shield 1. A first end edge 5 extends between the side edges 3,4 at a first end 7 of the cooling shield 1 and a second end edge 6 extend between the side edges 3, 4 at a second end 8 of the cooling shield 1. When the cooling shield is used to cool, clean and protect a liquor gun inside a combustion chamber of a recovery boiler, the first end 7 is an outer end of the cooling shield 1 which is located outside the combustion chamber of the recovery boiler and the second end 8 of the cooling shield 1 is an inner end or combustion chamber end which is located in the interior of the combustion chamber and protrudes from the combustion chamber wall a distance into the combustion chamber.

The cooling shield 1 has an outside shield wall 11 formed from a first steel plate, and an inside shield wall 12 formed from a second steel plate. The outside shield wall 11, has an outer surface 11' facing away from the inside shield wall 12 and an inner surface 11" facing the inside shield wall 12. The inside shield wall 12, has an outer surface 12' facing away from the outside shield wall 11 and an inner surface 12" facing the outside shield wall 11. The outside shield wall 11 and the inside shield wall are connected by side walls 13, 14 extending along the side edges 3, 4, of the cooling shield 1. The provision of side walls for connecting the outside and inside shield walls 11, 12 is optional to the cooling shields as disclosed herein. The side walls may be directly connected to each other in the manner shown in FIGS. 3 and 4.

The outside shield wall 11 and the inside shield wall 12 are placed at a distance from each other such that a cooling medium space 15 is formed between the inner surface 11" of the outside shield wall 11 and the inner surface 12" of the inside shield wall 12. In the cooling shield 1 shown in FIG. 1, the thickness t of the cooling shield 1, as measured in a radial direction R from the outer surface 11' of the outside shield wall 11 is uniform over the full cross-section of the cooling shield 1 from the first side edge 3 to the second side edge 4. In a variation of the FIG. 1 cooling shield 1, the outside shield wall 11 may be directly connected to the inside shield wall 12 along the first and second side edges 3, 4. In such case, a cross section through the cooling shield 1 will show the cooling medium space 15 with a shape that tapers towards the side edges 3,4.

The cooling shield 1 is shown with two cooling medium inlets 16', 16" arranged at the first end 7 of the cooling shield 1. When the cooling shield is mounted to a recovery boiler with the second end 8 protruding into the combustion chamber of the recovery boiler, the cooling medium inlets 16', 16" will generally be on the outside of the combustion chamber wall as is the case with the cooling shield 1 shown in FIG. 6. However, it is conceivable to alternatively or in addition thereto arrange one or more cooling medium inlets on the part of the cooling shield which is inserted into the combustion chamber. The cooling medium space 15 of the cooling shield 1 in FIG. 1 is closed at the first end 7 with a first end wall 18 and is closed at the second end 8 with a second end wall 19. The first and second end walls are optional to the cooling shields as disclosed herein. The outside shield wall 11 and the inside shield wall 12 may be directly coupled to each other. Furthermore, one wall or both of the end walls can be omitted. An open first end may serve as a cooling medium inlet. It is preferred that the second end 8 is a closed end to provide adequate circulation of cooling medium in the cooling medium space 15. Furthermore, it is to be understood that the number of cooling medium inlets may be only one or more than two, as set out herein. It is also to be understood that the one or more cooling medium inlets may be differently placed on the cooling shield.

A plurality of cooling medium outlets 17 are arranged in the outside shield wall 11 of the cooling shield 1. The cooling medium outlets 17 may be evenly distributed over the full outer surface 11' of the outside shield wall 11 in the combustion chamber end 8 of the cooling shield 1, as shown in FIG. 1 or in any other suitable manner, as disclosed herein. The cooling medium outlets 17 are arranged at the second end 8 constituting the combustion chamber end 8 of the cooling shield 1. The cooling medium outlets 17 are in communication with the cooling medium space 15 and are arranged to pass gaseous cooling medium and small amounts of water out from the cooling medium space 15 to the surroundings of the cooling shield 1 inside the combustion chamber of a recovery boiler when the cooling shield 1 is being used. The gaseous cooling medium which is let out through the cooling medium outlets 17 will generally be a mixture of a gaseous transport medium, vaporized water and a small amount of non-vaporized water. The part of the cooling shield 1 in FIG. 1 which is directed upward in the figure is also the part of the cooling shield 1 which will be directed upward in a combustion chamber of a recovery boiler when the cooling shield is being used. It is to be understood that the arrangement of cooling medium outlets may be different from that shown in FIG. 1. The number of cooling medium outlets may be greater or smaller, their distribution may be different and they may have other shapes than the circular shape shown in FIG. 1, such as a slit shape. Circular openings may have a diameter in the order of from 0.5 mm to 5 mm. Elongated, slit-shaped openings may have a width in the order of from 0.2 mm to 1.5 mm and a length in the order of from 2 mm to 20 mm.

As set out herein, the cooling medium outlets 17 may comprise or consist of a plurality of pores in the outside shield wall 11. Such pores are generally provided by the outside shield wall 11 being made by an inherently porous material. A porous material may have additional cooling medium outlets 17 formed therein, e.g., to create a higher outflow of spent cooling medium in selected portions of the cooling shield.

As set out herein, the cooling shield 1 may be adapted to be removably mounted to a liquor gun as a separate part or may form an integral part of a liquor gun.

Figure 2:
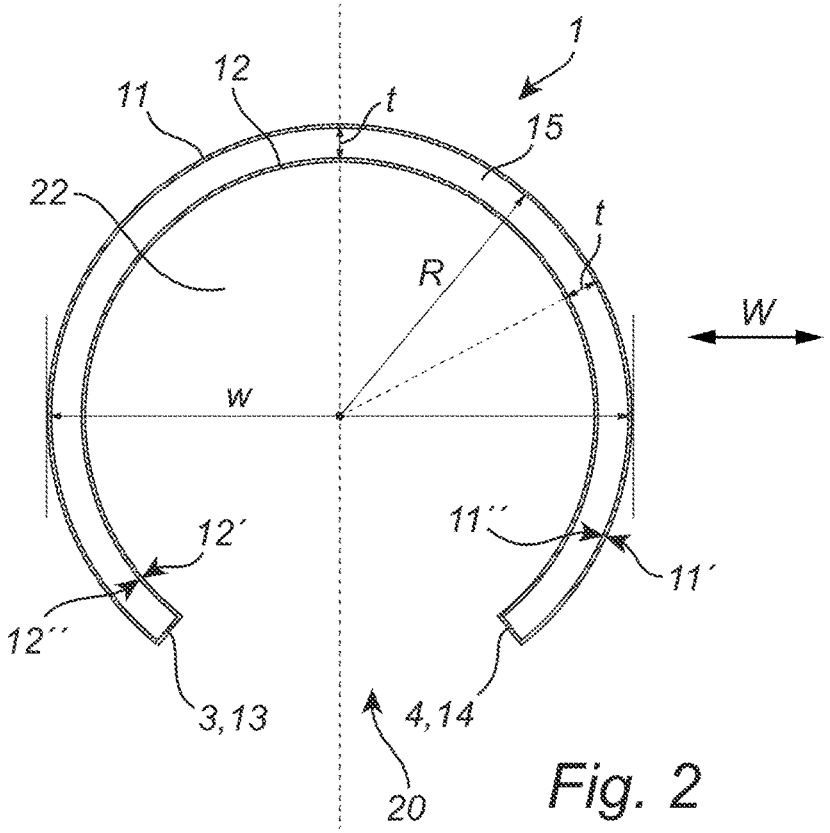
FIG. 2 shows a first example of a cross-section through a cooling shield for a liquor gun.
Figure 3:
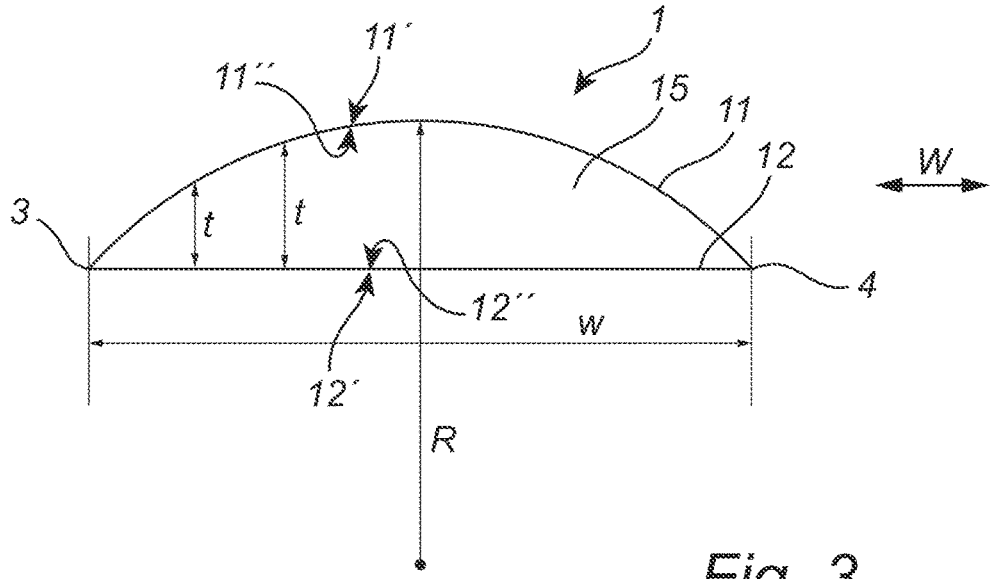
FIG. 3 shows a second example of a cross-section through a cooling shield for a liquor gun.
Figure 4:
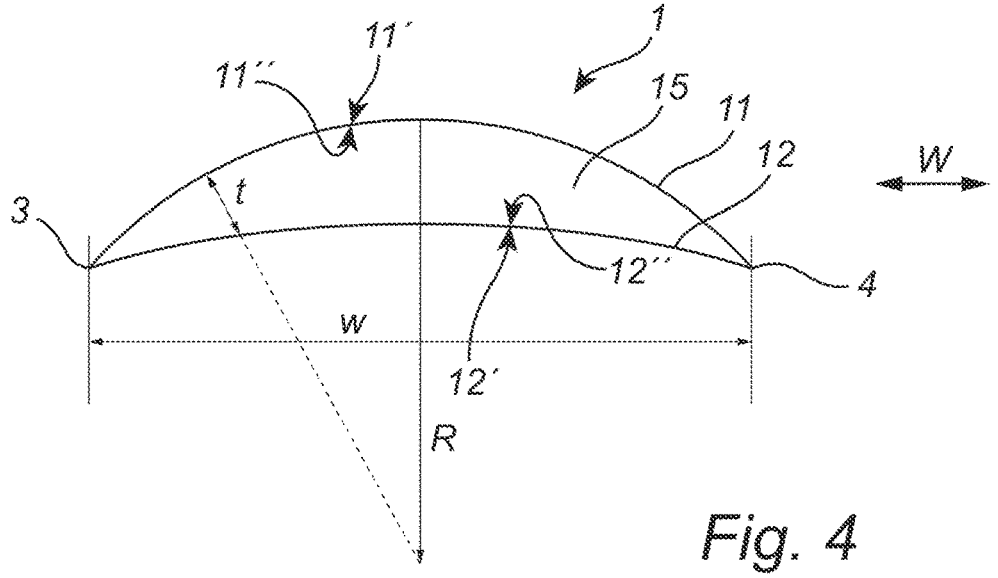
FIG. 4 shows a third example of a cross-section through a cooling shield for a liquor gun.

FIGS. 2 to 5 show examples of cooling shields 1 having different cross-sectional shape. The same reference numbers have been used to denote the same components of the cooling shields 1 of FIGS. 2 to 5. It is to be understood that features of the different cross-sections may be freely combined with each other. In particular, the outside and inside shield walls 11, 12 may be directly connected to each other along the side edges 3, 4 or may be connected by means of side walls 13, 14. When the outside and inside shield walls 11, 12 are directly connected to each other the cross-sectional shape of the cooling space 15 will be tapering towards the side edges 3, 4 as illustrated by FIGS. 3 and 4. By way of example, the FIGS. 1 and 5 cooling shields 1 may be modified by directly connecting the outside shield wall 11 to the inside shield wall 12 along the first and second side edges 3,4, resulting in a cooling shield 1 having a smaller thickness adjacent the side edges 3, 4 then centrally between the side edges 3, 4.

When both the outside shield wall 11 and the inside shield wall 12 are curved as shown in FIGS. 2 and 4, the thickness of the cooling shield 1 is measured from the outer surface 11' of the outside shield wall 11 to the outer surface 12' of the inside shield wall 12, in the radial direction R of the outer surface 11' of the outside shield wall 11.

When the inside shield wall 12 is planar, the thickness of the cooling shield is measured perpendicular to the plane of the inside shield wall 12 from the outer surface 11' of the outside shield wall 11 to the outer surface 12' of the inside shield wall 12. This is illustrated in FIGS. 3 and 5.

Figure 5:
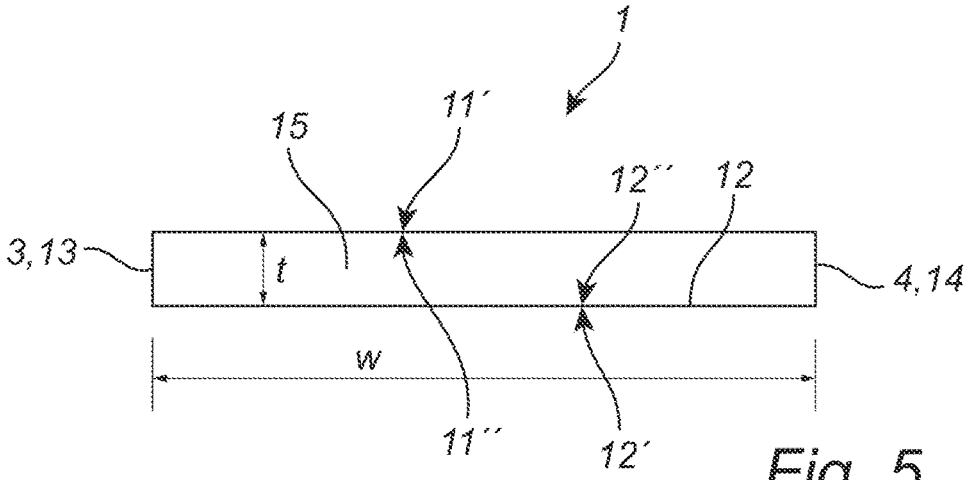
FIG. 5 shows a fourth example of a cross-section through a cooling shield for a liquor gun.

No cooling medium inlets or cooling medium outlets are shown in FIGS. 3-5. Such inlets and outlets may be arranged in any suitable manner as described herein, e.g., as shown in FIG. 1. Furthermore, the cooling shields 1 shown in FIGS. 2-5 may may be open at one or both ends. However, it is generally preferred that at least the second end which is configured for being arranged in the interior of a combustion chamber is a closed end, such that cooling medium can only exit from the cooling medium space 15 through the cooling medium outlets 17 arranged in the cooling shield 1.

Figure 6:
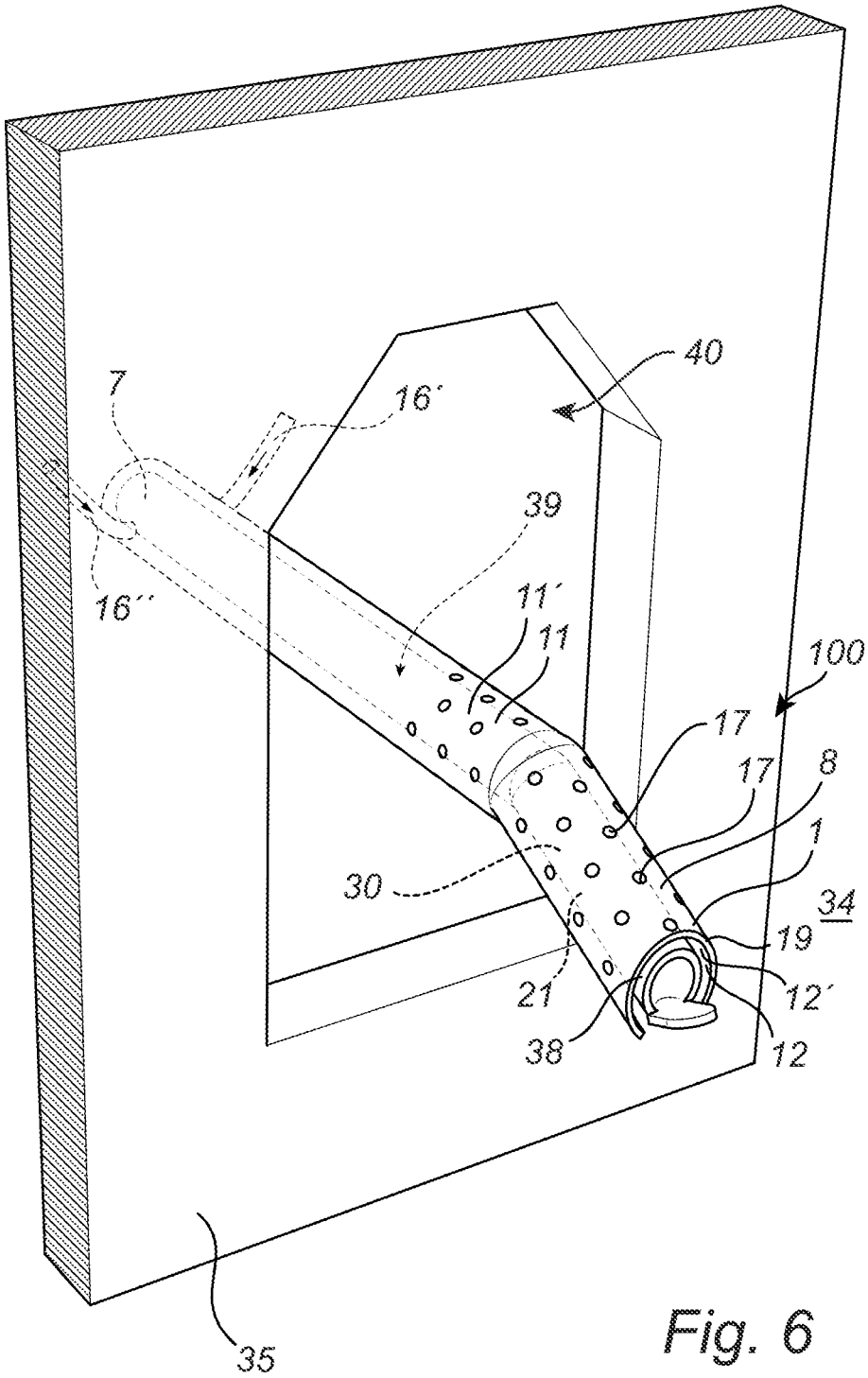
FIG. 6 shows a liquor gun system as disclosed herein.

FIG. 2 shows a cross section through a cooling shield 1 of the type shown in FIG. 1, where the outside and inside shield walls 11, 12 provide the cooling shield 1 with a uniform curvature, the radius of curvature of the outside shield wall 11 being larger than the radius of curvature of the inside shield wall 12 and the distance between the inner surface 11" of the outside shield wall 11 an the inner surface 12" of the inside shield wall 12 being the same all the way from the first side edge 3 to the second side edge 4 of the cooling shield 1. The cooling shield 1 in FIGS. 1 and 2 may be described as having a tubular shape with a gap 20 in the tube wall extending in the longitudinal direction of the cooling shield 1 between the first and second side edges 3, 4. As set out herein, the gap 20 may be larger or smaller than the gap shown in FIGS. 1 and 2. When the cooling shield 1 shown in FIGS. 1 and 2 is in use and is applied to cool and protect a liquor injection pipe of a liquor gun, as shown in FIG. 6, the cooling shield will cover and protect the upper part of the liquor injection pipe, as well as providing at least partial protection to the sides of the liquor injection pipe. The width of a cooling shield 1 as shown in FIGS. 1 and 2 is determined as the maximum width w, as measured in the width direction W between diametrically opposite points on the outer surface 11' of the outside shield wall 11. The cooling shield 1 in FIGS. 1 and 2 is sized such that a liquor injection pipe 21 of a liquor gun may be inserted into the cavity 22 defined by the outer surface 11' of the outside shield wall 11 such that the cooling shield 1 partially surrounds the liquor injection pipe 21 as illustrated by FIG. 6. The cross-section of a curved cooling shield such as the curved cooling shields 1 shown in FIGS. 1, 2 and 6 preferably occupies a circle segment which is large enough to allow a full width of a liquor injection pipe 21 to be covered. More preferably, the cooling shield 1 curves downward to at least partly cover also at the sides of the liquor injection pipe 21. As set out herein, a cooling, cleaning and protecting effect may be achieved also with a relatively narrow cooling shield which covers only the uppermost part of the liquor gun. However, a cooling shield 1 which is arranged above a liquor injection pipe 21 in a combustion chamber of a recovery boiler preferably has a width which is at least as large as the width of the liquor injection pipe 21. As set out herein, a circumferential extension of the cooling shield 1 around a liquor injection pipe 21 may be from 60° to 300°.

In all instances, the cooling shield as disclosed herein does not fully cover the lower part of the liquor injection pipe 21.

The cooling shields shown in FIGS. 3 and 4 have a curved outside wall 11. The provision of a curved outside wall may be beneficial in that solid matter which impinges on the shield may slide off the shield.

FIG. 6 shows a liquor gun system 100 comprising a liquor gun 30 and a cooling shield 1 as disclosed herein. The liquor gun system is shown when applied inside a combustion chamber 34 of a recovery boiler with a combustion chamber end of a liquor injection pipe 21 of the liquor gun 30 and a combustion chamber end 8 of the cooling shield 1 protruding from an opening 40 in the combustion chamber wall 35 into the combustion chamber 34. The liquor injection pipe 21 is arranged for supplying liquor to the combustion chamber 34 and comprises a nozzle 38 arranged at a combustion chamber end of the liquor injection pipe 21, the nozzle 38 being arranged for ejecting liquor into the combustion chamber 34 of the recovery boiler. The cooling shield 1 is applied at the upper outer surface 39 and on the sides of the liquor injection pipe 21, at a distance from the upper outer surface 39 of the liquor injection pipe 21, with the inside shield wall 12 of the cooling shield 1 facing the liquor injection pipe 21 and with the outside shield wall 11 of the cooling shield facing away from the liquor injection pipe 21. The cooling medium inlets 16', 16" are shown to be arranged on the first end 7 of the cooling shield 1 which is located on the outside of the combustion chamber 34.

The longitudinal extension of the combustion chamber end of the cooling shield 1 when applied to a liquor gun 30 as shown in FIG. 6 may be from 70% to 115% of the length of the combustion chamber end of the liquor injection pipe 21, i.e. of the length of the part of the liquor injection pipe 21 which is inserted into the combustion chamber 34.

When the liquor gun system 100 is applied inside a combustion chamber 34 of a recovery boiler as shown in FIG. 6, the cooling shield 1 may be used to cool the liquor injection pipe 21 of the liquor gun 30 by supplying a cooling medium comprising water and a transport medium to the cooling space 15 in the cooling shield 1. In addition to providing cooling of the liquor injection pipe 21, the spent cooling medium which exits through the cooling medium outlets, serves to reduce the amount of matter in the space around the liquor injection pipe 21, thus preventing deposits forming on the cooling shield and on parts of the liquor injection pipe which are not covered by the cooling shield. As set out herein, the water and a gaseous transport medium may be supplied to the cooling space 15 as a pre-mixed emulsion or as separate cooling medium components.

The invention claimed is:

1. A liquor gun system comprising:

a liquor gun for supplying liquor to a combustion chamber of a recovery boiler; and a cooling shield having a first side edge and a second side edge that extend in a longitudinal direction of the cooling shield, and a first end edge and a second end edge that extend between the first and second side edges, the cooling shield comprising:

an outside shield wall, and an inside shield wall that are connected along the side edges of the cooling shield, a cooling medium space located between the outside shield wall and the inside shield wall, and a cooling medium inlet and a cooling medium outlet that are arranged in communication with the cooling medium space, wherein the cooling medium outlet comprises a plurality of openings or pores in the outside shield wall;

wherein the cooling shield forms an integral part of the liquor gun.

2. The liquor gun system according to claim 1, wherein the outside shield wall comprises a first plate and the inside shield wall comprises a second plate.

3. The liquor gun system according to claim 1, wherein the outside shield wall is curved.

4. The liquor gun system according to claim 3, wherein the inside shield wall is curved.

5. The liquor gun system according to claim 4, wherein the cooling shield extends in a circumferential direction of the cooling shield over a circle segment of from 60° to 300°.

6. The liquor gun system according to claim 1, wherein the outside shield wall is connected to the inside shield wall by a first side wall extending along the first side edge of the cooling shield and by a second side wall extending along the second side edge of the cooling shield.

7. The liquor gun system according to claim 1, wherein the outside shield wall is connected to the inside shield wall along the second end edge of the cooling shield.

8. A liquor gun system comprising:

a liquor gun comprising a liquor injection pipe for supplying liquor to a combustion chamber of a recovery boiler, the liquor injection pipe comprising a nozzle arranged at a combustion chamber end of the liquor injection pipe, the combustion chamber end of the liquor injection pipe being configured for being inserted into the combustion chamber of the recovery boiler, the nozzle being arranged for ejecting liquor into the combustion chamber of the recovery boiler; and a cooling shield having a first side edge and a second side edge that extend in a longitudinal direction of the cooling shield, and a first end edge and a second end edge that extend between the first and second side edges, the cooling shield comprising:

an outside shield wall, and an inside shield wall that are connected along the side edges of the cooling shield, a cooling medium space located between the outside shield wall and the inside shield wall, and a cooling medium inlet and a cooling medium outlet that are arranged in communication with the cooling medium space, wherein the cooling medium outlet comprises a plurality of openings or pores in the outside shield wall;

wherein the cooling shield is located at least at the combustion chamber end of the of the liquor injection pipe and covers at least a portion of an upper outer surface of the liquor injection pipe, with the inside shield wall of the cooling shield facing the liquor injection pipe and with the outside shield wall of the cooling shield facing away from the liquor injection pipe.

9. The liquor gun system according to claim 8, wherein a width of the cooling shield is equal to or greater than a width of the combustion chamber end of the liquor injection pipe.

10. The liquor gun system according to claim 8, wherein a circumferential extension of the cooling shield around the liquor injection pipe is from 60° to 300°.

11. The liquor gun system according to claim 8, wherein a longitudinal extension of the combustion chamber end of the cooling shield along the upper outer surface of the liquor injection pipe is from 70% to 115% of a length of the combustion chamber end of the liquor injection pipe.

12. A method for cooling and shielding a liquor injection pipe in a liquor gun system according to claim 8, wherein the liquor gun system is mounted with the combustion chamber end of the liquor injection pipe and the cooling shield being inserted into a combustion chamber of a recovery boiler, the method comprising supplying a cooling medium comprising water and a gaseous transport medium to the cooling space in the cooling shield.

13. The method according to claim 12, wherein the water and the gaseous transport medium are supplied to the cooling space as a pre-formed mixture or as separate components.

14. The liquor gun system according to claim 7, wherein the outside shield wall is connected to the inside shield wall along the first end edge of the cooling shield.

15. The liquor gun system according to claim 8, wherein the outside shield wall comprises a first plate and the inside shield wall comprises a second plate.

16. The liquor gun system according to claim 8, wherein the outside shield wall is curved.

17. The liquor gun system according to claim 16, wherein the inside shield wall is curved.

18. The liquor gun system according to claim 8, wherein the outside shield wall is connected to the inside shield wall by a first side wall extending along the first side edge of the cooling shield and by a second side wall extending along the second side edge of the cooling shield.

19. The liquor gun system according to claim 8, wherein the outside shield wall is connected to the inside shield wall along the second end edge of the cooling shield.

20. The liquor gun system according to claim 19, wherein the outside shield wall is connected to the inside shield wall along the first end edge of the cooling shield.

* * * * *